United States Patent [19]

Reaser

[11] Patent Number: 4,520,518

[45] Date of Patent: Jun. 4, 1985

[54] BED SHEET INSTALLATION AND RETENTION

[76] Inventor: Brian K. Reaser, 600 E, Road 880S, Bluffton, Ind. 46714

[21] Appl. No.: 537,703

[22] Filed: Sep. 30, 1983

[51] Int. Cl.[3] ..... A44B 21/00

[52] U.S. Cl. ..... 5/498; 5/494; 5/496; 5/508; 24/72.5

[58] Field of Search ..... 5/451, 452, 494, 496, 5/498, 508; 24/72.5

[56] References Cited

U.S. PATENT DOCUMENTS

| | | | |
|---|---|---|---|
| 893,517 | 7/1908 | Keller | 24/72.5 |
| 1,072,469 | 9/1913 | Johnson | 24/72.5 |
| 3,962,757 | 6/1976 | Gedney | 24/72.5 |
| 4,400,836 | 8/1983 | Pelura | 5/498 |

FOREIGN PATENT DOCUMENTS

| | | | |
|---|---|---|---|
| 2228156 | 12/1973 | Fed. Rep. of Germany | 24/72.5 |

*Primary Examiner*—Gary L. Smith
*Assistant Examiner*—Michael F. Trettel
*Attorney, Agent, or Firm*—George A. Gust

[57] ABSTRACT

A retaining device for a bed cover such as a bed sheet having a clasp for releasably gripping a bed cover corner and a hand hold portion near one end for manipulating the retainer is disclosed and in one preferred form comprises a flat sheet of rubber-like material having a leading edge which is beveled and rounded at the end opposite the handle or hand grip portion and with a suspender-like gripper clip positioned intermediate the two ends. The device is suitable for use on conventional beds and finds particular utility when used in conjunction with a waterbed. The retaining device is also suitable for use with either conventional bed clothes or fitted bed clothes or sheets wherein a sewn in pocket configured to overly the corner of a mattress is provided.

6 Claims, 4 Drawing Figures

BED SHEET INSTALLATION AND RETENTION

BACKGROUND OF THE INVENTION

The present invention relates generally to a device for retaining the corners of a bed sheet, blanket or the like in position tucked under respective corners of a mattress so as to not be dislodged therefrom during normal use.

Ever since man first placed a cover over a mattress he has been plagued by the problem of keeping that cover in position on the mattress. Attempts to obviate this problem have included forming as by sewing a pocket in corners of the cover configured to closely fit about a corresponding mattress corner with this attempted solution currently commercially available in the form of so called "fitted sheets". Such fitted sheets represent a reasonable solution to the problem when employed on conventional mattresses of the type containing coil springs, foam rubber or other padding materials where the mattress has a relatively strong tendency to maintain its shape despite pulling and tugging on the cover, however, with the advent of waterbeds where a large plastic water tight enclosure is positioned within a rigid frame and filled with water, such fitted sheets have not proven to be an entirely satisfactory solution to the problem. It would be highly desirable to provide a bed cover anchoring arrangement which could be employed with either fitted sheets or more conventional unfitted bed clothes and which would be applicable either to mattresses of conventional design or to waterbed mattress.

Less commercially well known attempts to solve this ever present problem are illustrated for example in U.S. Pat. No. 731,844 and U.S. Pat. No. 4,276,667 issued over three quarters of a century apart and illustrating the persistence of the problem. In the earlier patent, a hook arrangement grasps the bed cover at one end and a second hook arrangement grasps springs beneath the mattress at the other end effectively tying the bed cover and springs together. Clearly, accessible springs are required for this technique. In the more recent patent, a base having tiny slippage preventing hooks is lodged between upper and lower mattress sections and a rubber block is held against a mattress side wall portion with the retained bed cover being gripped therebetween. With this latter approach, slippage of the bed cover between the rubber block and mattress edge are still possible and the structure does not fit flush with the edge of the mattress. Thus, neither of these patented approaches are suitable for a waterbed environment.

SUMMARY OF THE INVENTION

Among the several objects of the present invention may be noted the provision of a bed cover retainer for holding an edge portion of a bed cover in position beneath an edge of a bed mattress; the provision of a bed cover retainer applicable to both fitted sheets and more conventional covers as well as being applicable to both conventional mattresses and the liquid filled mattresses of waterbeds; and the provision of a bed cover retainer positionable beneath corners of a waterbed mattress which solves the bed cover slippage problem heretofore unsolved in the waterbed environment. These as well as other objects and advantageous features of the present invention will be in part apparent and in part pointed out hereinafter.

In general, the retainer comprises a semi-rigid generally flat anchor of a rubber-like material having an elongated stem portion with a handle near one end and with a bed cover gripper permanently fastened to the anchor for grasping a section of the cover near an edge and holding that cover in position beneath the mattress.

Also in general and in one form of the invention a bed cover corner retainer includes a resilient generally flat elongated body with a hand grip portion near one end and an arrangement intermediate the hand grip portion and the opposite end of the body for releasably gripping a corner of a bed cover for positioning and retaining the bed cover beneath a corner of a mattress.

BRIEF DESCRIPTION OF THE DRAWING

Corresponding reference characters indicate corresponding parts throughout the several views of the drawing.

The exemplifications set out herein illustrated a preferred embodiment of the invention in one form thereof and such exemplifications are not to be construed as limiting the scope of the disclosure or the scope of the invention in any manner.

DESCRIPTION OF THE PREFERRED EMBODIMENT

Figure 3:
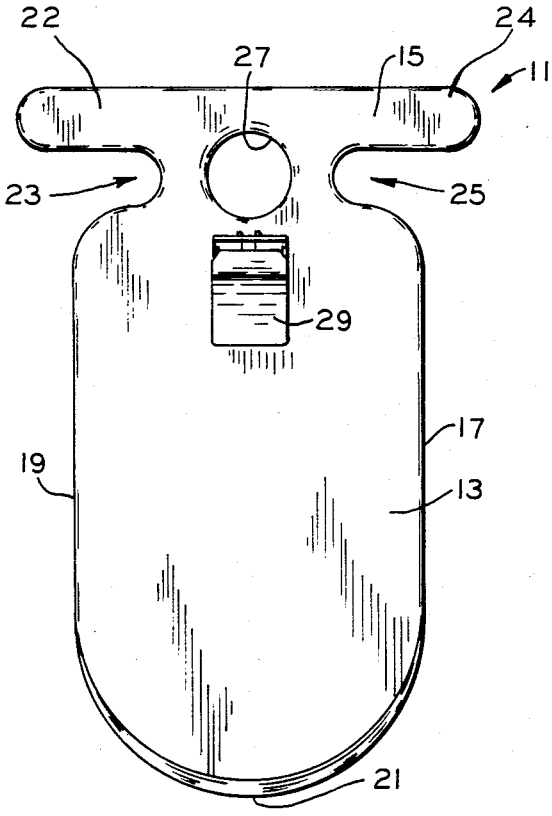
FIG. 3 is a plan view of the retainer of FIGS. 1 and 2.
Figure 4:
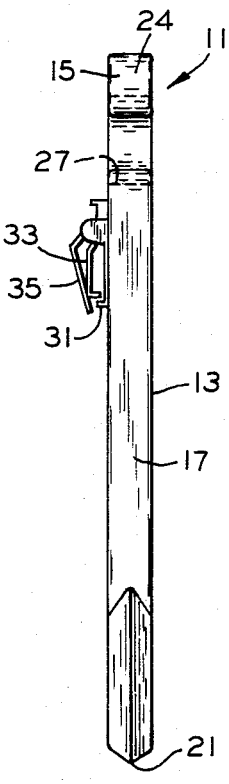
FIG. 4 is an edge view of the retainer as viewed from the right of FIG. 3.

Referring first primarily to FIGS. 3 and 4 the bed cover retainer 11 will be seen to include an elongated stem portion 13 and a handle or hand grip portion 15 at one end of the elongated body 13 with the end of the body 13 opposite the hand grip portion 15 being rounded in a generally semi-circular configuration between the edges 17 and 19 of the elongated portion and, as best seen in FIG. 4, with that leading end 21 being beveled with the rounding and the beveling aiding in the movement of the retainer along the edge of and underneath a mattress. The hand grip portion includes tabs 22 and 24 forming notches 23 and 25 allowing the user to wrap his fingers about the handle portion 15 and this handle portion may further include a generally centrally located finger accepting hole 27 which further facilitates the user grasping the handle end of the retainer. The body of the retainer as thus far described may be formed of a rubber-like material on the order of one-quarter to one-half inch thick and of a generally flat configuration to fit neatly beneath a mattress. When constructed of such a material the retainer is sufficiently stiff so as to not bend around a corner of the mattress under normal pulling forces exerted on bed clothes.

The retainer also includes an arrangement 29 intermediate the ends of the body for releasably gripping a corner of a bed cover. As illustrated this gripper 29 comprises a fixed jaw 31 and a pivotable jaw 33 which pivots under the control of a cam lever 35 so that when lever 35 is moved from the position illustrated in FIG. 4 clockwise through about 90° the movable jaw 33 separates from the fixed jaw 31 a distance sufficient to receive an edge portion of the bed cover. Counterclockwise pivoting of lever 35 cam actuates the jaw 33 also in a counterclockwise direction as viewed in FIG. 4 to close the jaws about the bed cover edge securely gripping that edge.

Figure 1:
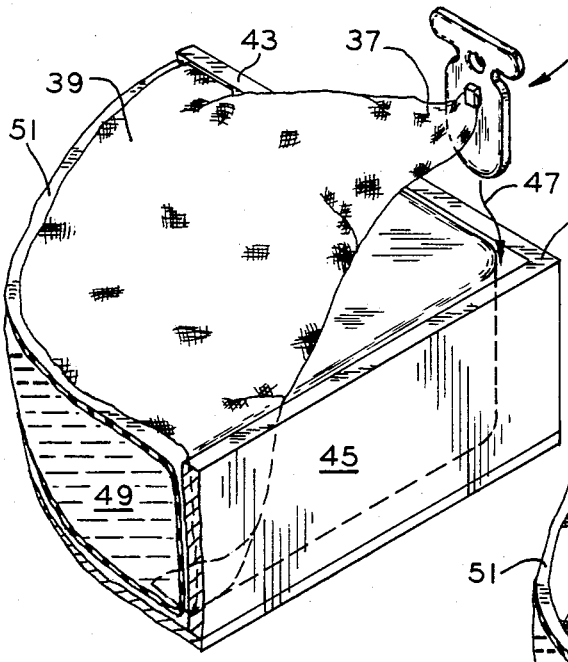
FIG. 1 is a perspective view of a portion of an illustrative waterbed environment with the retainer of the present invention gripping a corner of a bed cover preparatory to tucking that cover underneath the mattress.

Referring to FIG. 1 the bed sheet 37 has a corner thereof gripped by the jaws 31 and 33 preparatory to tucking the bed sheet 37 beneath mattress 39.

Figure 2:
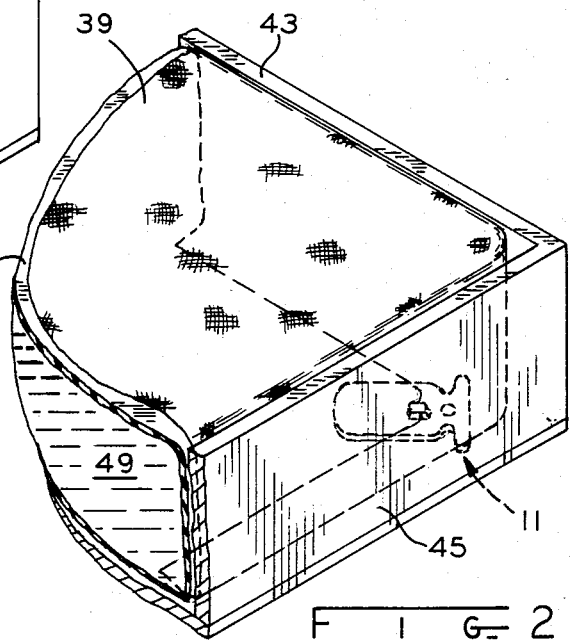
FIG. 2 is a view similar to FIG. 1 but showing the retainer and bed cover in their final position tucked beneath the mattress corner.

In the illustrative environment of FIGS. 1 and 2 the water mattress 39 having water 49 in a water tight container of flexible material 51 nests within a wooden frame 41 having upstanding side walls such as 43 and 45 which side walls of course entirely surround the periphery of water mattress 39. The corner of sheet 37 is now tucked in place by the user grasping the handle portion 15 and inserting the stem portion 13 downwardly as illustrated by arrow 47 between mattress 39 and the side walls 45 and 43 and subsequently displacing the lower corner of mattress 39 somewhat so as to tuck the retainer 11 underneath the mattress 39 as illustrated in FIG. 2 where that retainer will remain functioning as an anchor to hold the bed clothes in position until those bed clothes are changed. Flexing of stem 13 facilitates movement of the retainer around the mattress corner.

From the foregoing it is now apparent that a novel bed cover retainer has been disclosed meeting the objects and advantageous features set out herein before as well as others and that many modifications as to the precise configurations, shapes and details are possible. For example, while the bed cover gripper 29 as described is substantially the same as the gripper clips commonly found on suspenders for attachment to an upper edge of a pair of pants, one half of a conventional zipper could be fastened to the body 13 with the other half of that conventional zipper permanently affixed to the particular bed cover to be used so that the two would be joined by a zipping action rather than a clasping action. Numerous other modifications will readily suggest themselves to those of ordinary skill in the art and such modifications may be made without departing from the spirit of the invention or the scope thereof as set out by the claims which follow.

What is claimed is:

1. A bed-cover retainer for holding an edge portion of a bed-cover in position beneath an edge of a bed mattress comprising a semi-rigid generally flat anchor having an elongated stem portion with a handle portion near one end of the stem portion, and a bed-cover gripper permanently fastened to the anchor for selectively fastening a section of the bed-cover near an edge thereof to the anchor whereby the bed-cover may be fastened to the anchor and then the anchor slid downwardly along the side and then under the mattress to lie generally flat beneath the mattress and retained by the weight thereof to hold the bed-cover in position tucked about the mattress, the handle portion comprising a pair of oppositely extending lateral tabs.

2. The retainer of claim 1 wherein the handle portion further includes a finger accepting hole generally centrally positioned between the tabs.

3. A bed-cover retainer for holding a corner of a bed-cover in position beneath a corresponding corner of a generally rectangular bed mattress comprising a resilient generally flat elongated body with a hand grip portion near one end, and means intermediate the hand grip portion and the opposite end of the body for releasably gripping a corner of a bed-cover, whereby a bed-cover corner may be gripped and the retainer positioned to lie beneath a corner of the mattress to retain the bed-cover corner in position tucked under the corner of the mattress, the hand grip portion comprising a pair of oppositely extending lateral tabs.

4. The retainer of claim 3 wherein the hand grip portion comprises a pair of oppositely extending lateral tabs.

5. The retainer of claim 3 wherein the hand grip portion further includes a finger accepting hole generally centrally positioned between the tabs.

6. A bed-cover retainer for holding a corner of a bed-cover in position beneath a corresponding corner of a generally rectangular bed mattress comprising a resilient generally flat elongated body with a hand grip portion near one end, and means intermediate the hand grip portion and the opposite end of the body for releasably gripping a corner of a bed-cover, whereby a bed-cover corner may be gripped and the retainer positioned to lie beneath a corner of the mattress to retain the bed-cover corner in position tucked under the corner of the mattress, said opposite body end comprising a leading edge when the retainer is moved to a position underneath the mattress, the leading edge having a thickness bevel and being rounded between the elongated edges of the body to aid movement of the retainer toward a position beneath the mattress.

* * * * *